US005527032A

United States Patent [19]

Coleman et al.

[11] Patent Number: 5,527,032

[45] Date of Patent: Jun. 18, 1996

[54] MULTIPLE SPORT PRACTICE SYSTEM

[75] Inventors: Carol V. Coleman; Anne B. Herman, both of Larchmont, N.Y.

[73] Assignee: Ballwall, Inc., Larchmont, N.Y.

[21] Appl. No.: 221,809

[22] Filed: Apr. 1, 1994

[51] Int. Cl.[6] ..... A63B 69/40

[52] U.S. Cl. ..... 273/26 A; 273/55 R; 273/410

[58] Field of Search ..... 273/26 A, 29 A, 273/401, 181 A, 181 F, 127 K, 127 D, 407, 410, 185 R, 181 R, 323, 324, 184 R, 348, 378, 396, 397, 398, 399, 400, 402, 55 R

[56] References Cited

U.S. PATENT DOCUMENTS

| | | | |
|---|---|---|---|
| 469,554 | 2/1892 | Favor . | |
| 2,201,865 | 5/1940 | Kriekard | 273/26 A |
| 2,839,300 | 6/1958 | Blaha | 273/26 A |
| 2,873,696 | 2/1959 | Ziel | 273/26 A |
| 2,873,969 | 2/1959 | Ziel | 273/26 A |
| 4,083,559 | 4/1978 | Owen | 273/26 A |
| 4,118,028 | 10/1978 | Larkin . | |
| 4,127,267 | 11/1978 | Bay et al. . | |
| 4,183,524 | 1/1980 | Kifferstein et al. . | |
| 4,210,326 | 7/1980 | Booth et al. . | |
| 4,254,952 | 3/1981 | Playter, Jr. . | |
| 4,497,485 | 2/1985 | Macosko . | |
| 4,743,020 | 5/1988 | Muerer . | |
| 4,796,886 | 1/1989 | Loh . | |
| 4,905,996 | 3/1990 | Tallent et al. | 273/26 A |
| 4,980,935 | 1/1991 | Kazanowski et al. . | |
| 5,333,859 | 8/1994 | Gery | 273/26 A |

OTHER PUBLICATIONS

"Strike Zone" advertised in Fall 1993 catalog entitled "Physical Education and Recreation" published by Flag House, Inc., p. 18.

"Football Buddy" advertised in Spring 1993 brochure published by Markdown Playground, Westlake Village, CA.

*Primary Examiner*—Theatrice Brown

*Attorney, Agent, or Firm*—Maurice M. Klee

[57] ABSTRACT

A system for playing or practicing multiple sports is provided. The system includes a backstop having an aperture and a removable pouch located behind the aperture for capturing a ball or other object directed at the aperture by the user. The pouch is designed to stand away from the backstop so that it can effectively capture the object and remain open after having captured a number of objects. The system includes overlays which are releasably attached to the backstop to change the sport being practiced or played. In addition to its use in capturing objects, the pouch also serves as a container for storage and transport of the system.

25 Claims, 5 Drawing Sheets

MULTIPLE SPORT PRACTICE SYSTEM

BACKGROUND OF THE INVENTION

1. Field of the Invention

This invention relates to equipment for use in practicing and/or playing a variety of sporting activities, including, without limitation, baseball, football, soccer, lacrosse, and hockey.

2. Description of the Prior Art

A variety of practice equipment has been proposed for sporting activities. Examples of such equipment are shown in Bay et al., U.S. Pat. No. 4,127,267, Booth et al., U.S. Pat. No. 4,210,326, Favor, U.S. Pat. No. 469,554, Kifferstein et al., U.S. Pat. No. 4,183,524, Kriekard, U.S. Pat. No. 2,201,865, Larkin, U.S. Pat. No. 4,118,028, Loh, U.S. Pat. No. 4,796,886, Macosko, U.S. Pat. No. 4,497,485, Meurer, U.S. Pat. No. 4,743,020, Playter, Jr., U.S. Pat. No. 4,254,952, Tallent et al., U.S. Pat. No. 4,905,996, and Ziel, U.S. Pat. No. 2,873,969.

Notwithstanding this variety of proposed designs, to date, there has not existed a convenient, practical, and economical system for practicing and/or playing a variety of sports in the confines of a typical residential setting. In particular, what the art has needed is a sports practice system which is of a size large enough to be effectively used by children of all ages, including, in particular, young children, and at the same time is easy to set up, easy to store, usable with a variety of sports, and manufacturable at a reasonable cost. As discussed below the present invention provides such a sports practice system.

SUMMARY OF THE INVENTION

In accordance with certain of its aspects, the invention provides a system for playing or practicing one or more sports, each of which employs a moving object (e.g., a baseball, football, soccer ball, etc.) comprising:

(a) a backstop for interrupting the flight of the moving object, said backstop comprising a backstop body and means for releasably attaching the backstop body to an external support such as a swingset, said backstop body having a front face and a back face and an aperture;

(b) a pouch for collecting a moving object which has passed through the aperture, said pouch being formed of a fabric material and having a pouch body which forms an opening; and (c) means for releasably attaching the pouch to the back face of the backstop body so that the opening formed by the pouch body surrounds the aperture;

wherein the pouch body has a configuration which causes it to stand away from the back face of the backstop body.

The use of a removable pouch provides the important advantage that the pouch can be used as a container for the system during storage and transit. The use of a pouch which has a configuration which causes it to stand away from the back face of the backstop allows the pouch to effectively collect a moving ball (object) during use of the system. If the pouch did not have such a configuration, the probability that a moving ball would be captured by the pouch after entering the aperture, as opposed to bouncing out of the aperture, would be greatly reduced.

The stand-away configuration also allows the pouch to effectively collect multiple balls (objects). Without such a configuration, as soon as one, or at most a few balls, were collected in the pouch, the pouch would close down against the aperture and no further balls could enter the pouch and be collected.

In certain preferred embodiments, the pouch body includes first, second, and third portions, where the first portion is located behind the aperture and the second and third portions are attached to one other along their side edges to form a receptacle for the collected balls (objects). The first portion has a width which is wider than that of the third portion, and the second portion has a graduated width which progresses from that of the first portion to that of the third portion. By sewing the sides of the third portion to the sides of the second portion, the desired configuration is produced wherein the pouch stands away from the back face of the backstop body. By including pleats in the top edge of the first portion which causes the width of that edge, after pleating, to be substantially equal to the width of the third portion, the stand away effect is further enhanced.

In accordance with another of its aspects, the invention provides a system for playing or practicing one or more sports, each of which employs a moving object, comprising:

(a) a backstop for interrupting the flight of the moving object, said backstop comprising a backstop body and means for releasably attaching the backstop body to an external support, said backstop body having a front face and a back face and an aperture;

(b) a pouch for collecting a moving object which has passed through the aperture, said pouch being attached to the back face of the backstop body;

(c) an overlay for covering a portion of the front face of the backstop; and (d) means for releasably attaching the overlay to the system.

The overlay allows the system to be used for different sports. In one aspect of this feature, the backstop contains a first set of graphics, e.g., baseball graphics, and the overlay contains a second set of graphics, e.g., lacrosse graphics. Use of the overlays with their different graphics allows the user to simulate the playing of different sports.

A second aspect of the overlay feature involves changing the size of the aperture. For example, for a football overlay, it is generally desirable to make the aperture smaller. Further, for a soccer overlay, the aperture can be completely covered. It should be noted that overlays can be used to change the aperture size without changing the sport. For example, an overlay can be used in a baseball motif to make a smaller strike zone if desired.

The accompanying drawings, which are incorporated in and constitute part of the specification, illustrate the preferred embodiments of the invention, and together with the description, serve to explain the principles of the invention. It is to be understood, of course, that both the drawings and the description are explanatory only and are not restrictive of the invention.

Figure 1:
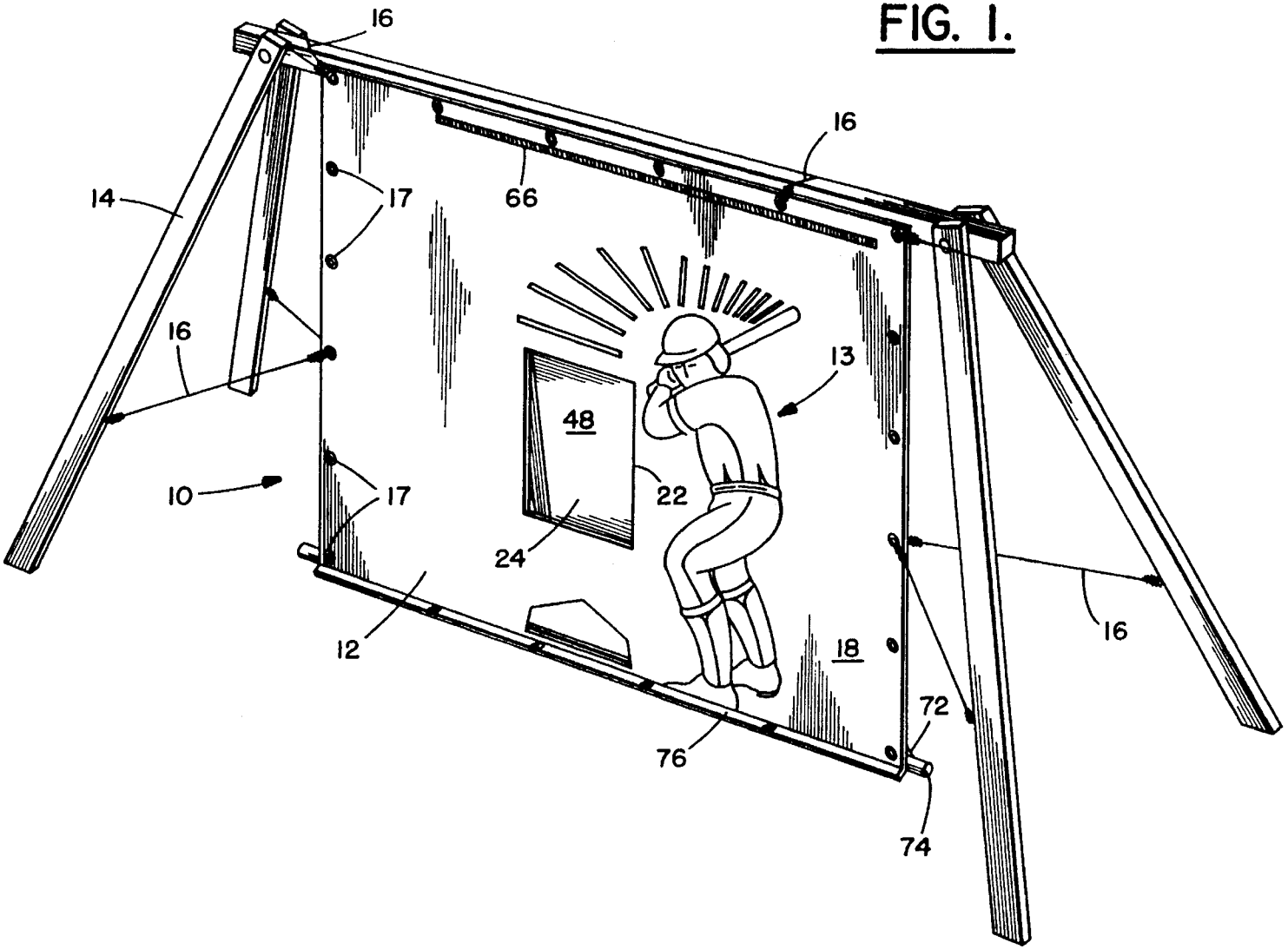
FIG. 1 is a perspective view of a baseball practice system constructed in accordance with the invention.
Figure 2:
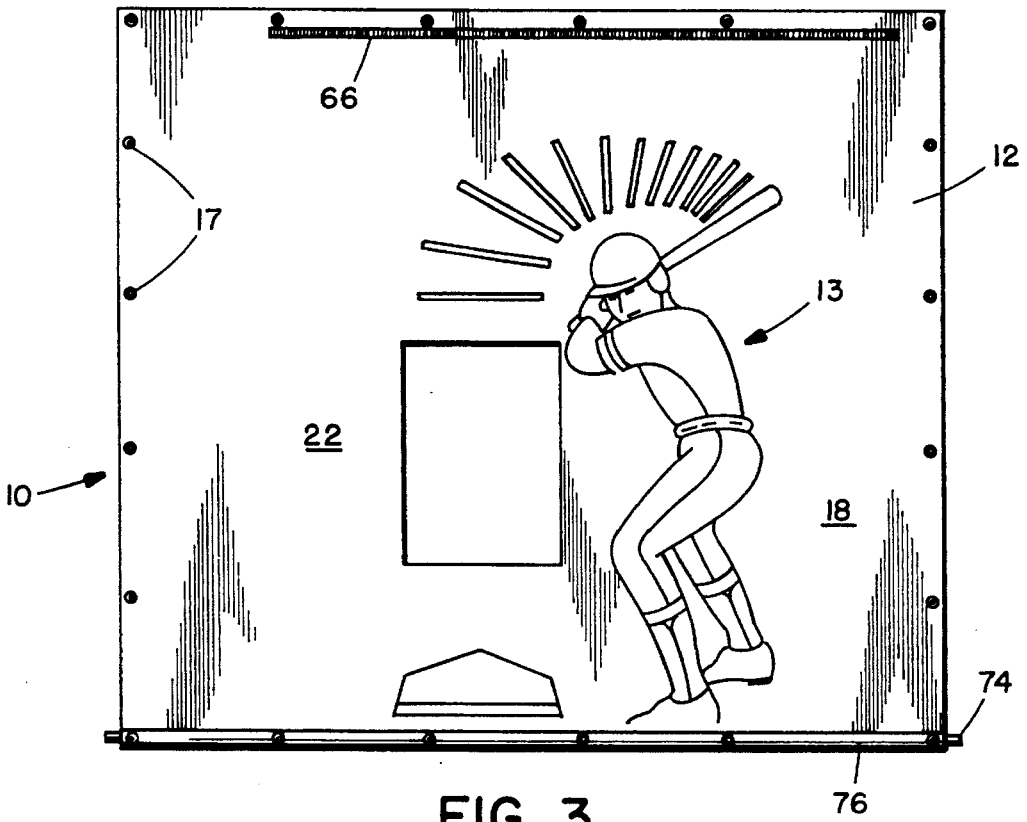
FIG. 2 is a front view of the backstop of the system of FIG. 1.

The reference numbers used in the drawings correspond to the following:

| | |
|---|---|
| 10 | backstop |
| 12 | backstop body |
| 13 | baseball graphic |
| 14 | external support for the backstop |
| 16 | elastic shock cords |
| 17 | grommets |
| 18 | front face of the backstop body |
| 20 | back face of the backstop body |
| 22 | aperture in the backstop body |
| 24 | pouch |
| 26 | pouch body |
| 28 | opening formed by the pouch body |
| 30 | VELCRO strip (hook type) |
| 32 | VELCRO strip (hook type) |
| 34 | VELCRO strip (hook type) |
| 36 | VELCRO strip (hook type) |
| 38 | VELCRO strip (loop type) |
| 40 | VELCRO strip (loop type) |
| 42 | VELCRO strip (loop type) |
| 44 | VELCRO strip (loop type) |
| 46 | VELCRO strip (loop type) |
| 48 | first portion of pouch body |
| 50 | second portion of pouch body |
| 52 | third portion of pouch body |
| 54 | receptacle portion of pouch |
| 56 | pleats in first portion of pouch body |
| 58 | football overlay |
| 60 | football graphic |
| 62 | soccer overlay |
| 64 | soccer graphic |
| 66 | VELCRO strip (loop type) |
| 68 | VELCRO strip (hook type) |
| 70 | reduced sized aperture |
| 72 | dowel sleeve |
| 74 | dowel |
| 76 | flap |
| 78 | left hand edge of portion 50 |
| 80 | right hand edge of portion 50 |
| 82 | left hand edge of portion 52 |
| 84 | right hand edge of portion 52 |
| 86 | free edge of portion 52 |
| 88 | free edge of portion 48 |
| 90 | arrows illustrating closing of the pouch |
| 92 | fibers of open-weave fabric |
| 94 | openings of open weave fabric |

DESCRIPTION OF THE PREFERRED EMBODIMENTS

As shown in the figures, the multiple sport practice system of the invention includes a backstop 10 having a backstop body 12 in which is formed an aperture 22. As illustrated in FIG. 1, the system is for use in the play or practice of baseball and thus includes a baseball graphic 13 on its front face 18. The user, of course, can practice whatever sport he or she desires with the equipment.

Backstop 10 is supported by external support 14 which in FIG. 1 is a swingset. A variety of other external supports can be used, including the framing surrounding the opening of a garage door, appropriately spaced trees or poles, a portion of a fence, or the like. Backstop 10 is releasably attached to the external support by elastic shock cords 16 which are hooked through grommets 17. Other means of releasable attachment can be used if desired, such as, rope, screw-in hooks, S-hooks, VELCRO strips, and the like.

To keep the backstop from undergoing significant movement during use, backstop body 12 preferably includes sleeve 72 for receiving dowel 74. The dowel serves to weight the bottom end of the backstop. To help prevent balls (objects) from passing under the backstop when the system is used on uneven ground, the backstop body preferably includes a flap 76 which extends forward from front face 18.

Pouch 24 is attached to the back face 20 of backstop body 12 and serves to collect balls, pucks, and the like which have passed through aperture 22. As can be seen most clearly in FIG. 4, pouch 24 includes pouch body 26 which forms an opening 28, which preferably corresponds in size to aperture 22, although a larger opening can be used if desired. As can also be seen in FIG. 4, pouch 24 has a stand-away configuration. A construction for the pouch which achieves this configuration is discussed below.

Figure 3:
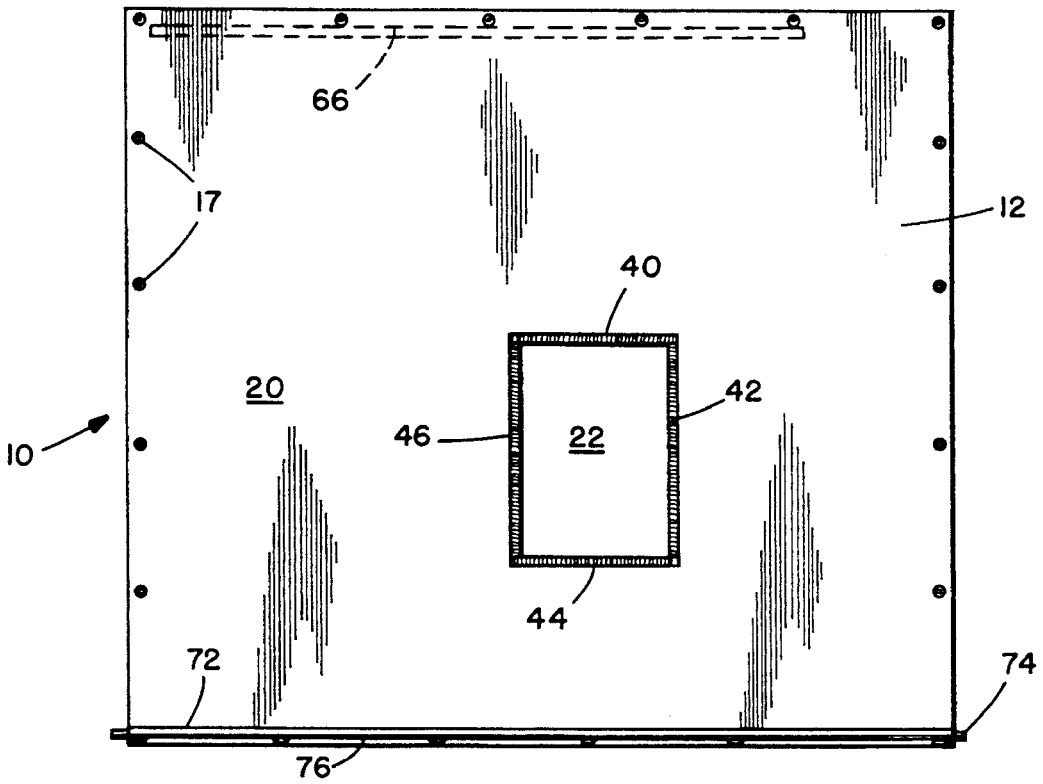
FIG. 3 is a back view of the backstop of the system of FIG. 1.
Figure 4:
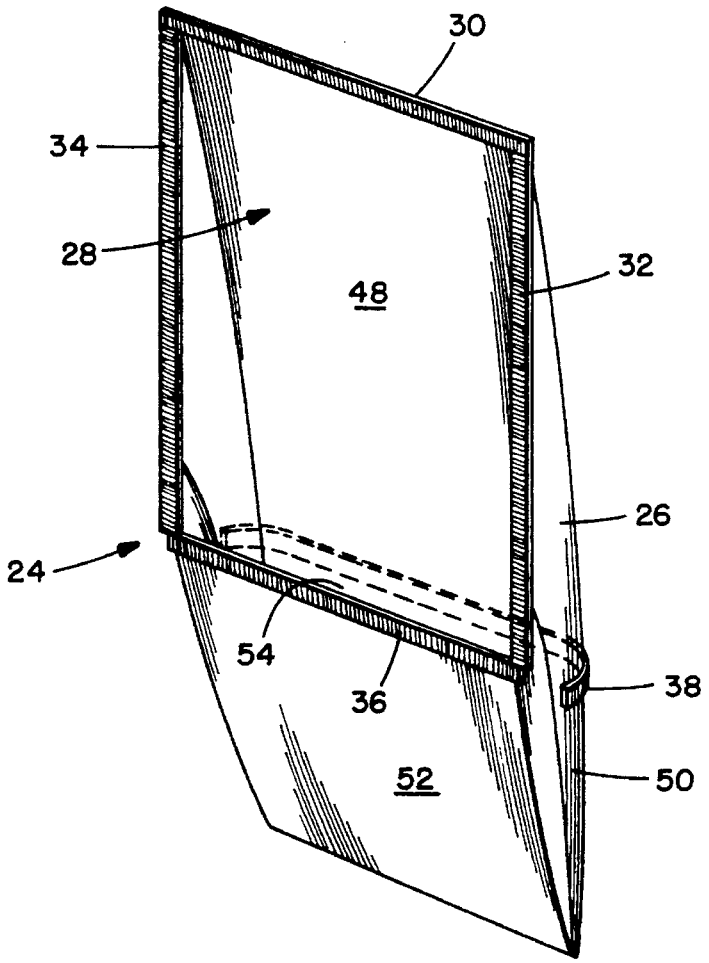
FIG. 4 is a perspective view of a pouch constructed in accordance with the invention.

Pouch 24 is preferably releasably attached to the back face 20 of backstop body 12. Alternatively, the pouch can be permanently attached to the backstop by, for example, being sewn thereto, although this is a much less preferred approach. As illustrated in FIGS. 3 and 4, the pouch can be releasably attached to the backstop body by means of VELCRO strips 30–36 which surround opening 28 of the pouch and VELCRO strips 40–46 which surround aperture 22 of the backstop.

The VELCRO strips on the pouch are preferably of the hook type, while those on the backstop body are preferably of the loop type, although the opposite configuration, as well as mix and match configurations, can be used if desired. Also, although referred to herein as VELCRO strips, hook and loop systems sold under other trademarks can be used in the practice of the invention. Instead of VELCRO strips, the pouch can be releasably attached to the backstop by other means, including snaps, clips, S-hooks and grommets, cable ties, and the like.

Figure 6:
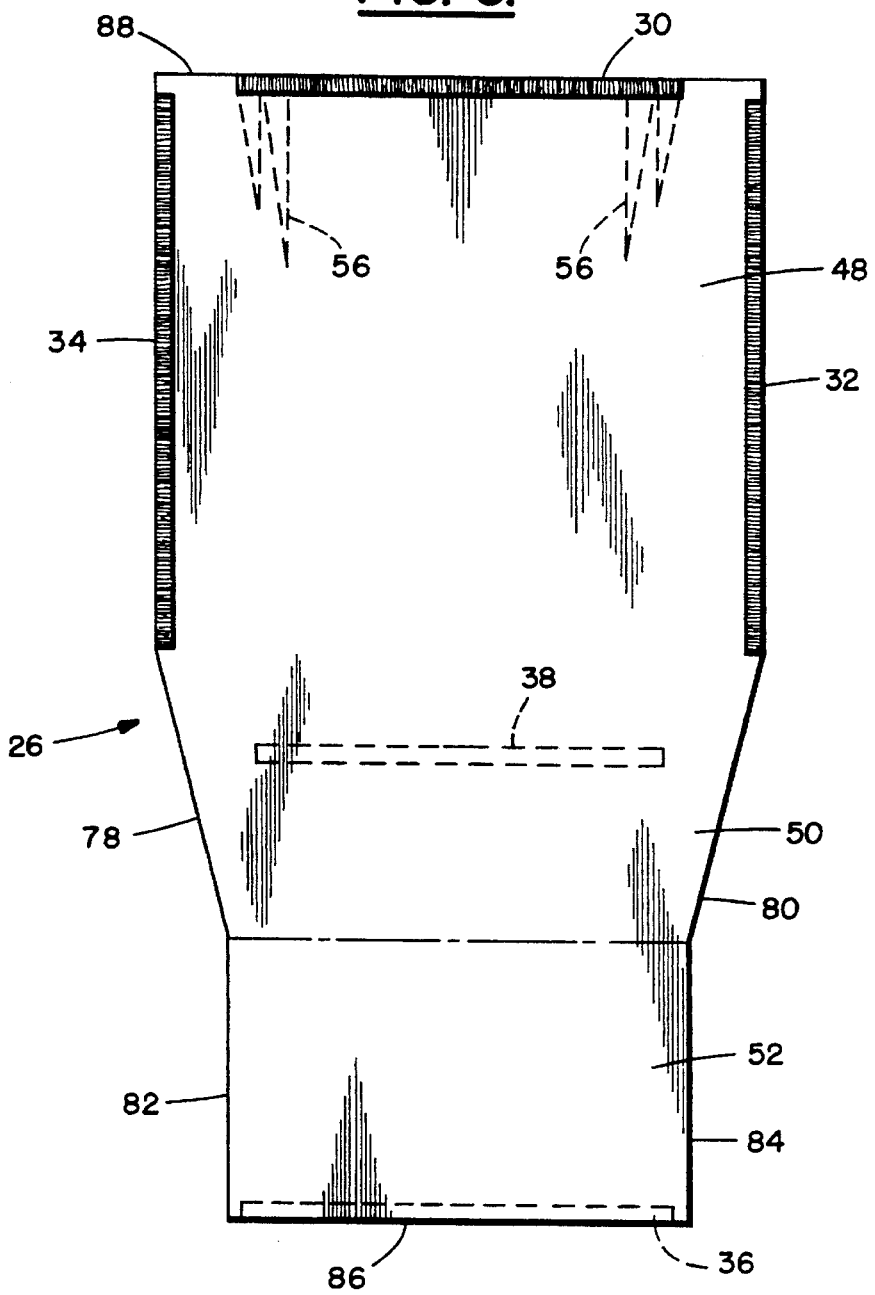
FIG. 6 is a pattern for preparing the pouch of FIG. 4.

As indicated above, pouch 24 has a configuration which causes it to stand away from back face 20 of backstop body 12. A suitable pattern for forming the pouch is shown in FIG. 6. As shown therein, pouch body 26 includes first portion 48, second portion 50, and third portion 52.

As shown in FIG. 1, first portion 48 is located behind aperture 22 in the assembled system and stands away from the aperture so as to be effective in capturing balls or other objects which pass through the aperture. The second and third portions form receptacle 54 which collects the balls (objects) which have passed through the aperture (see FIG. 4).

First portion 48 has a width which is wider than that of third portion 52, and second portion 50 has a graduated width which progresses from that of the first portion to that of the third portion. As a result of this configuration, when edge 82 is sewn to edge 78 and edge 84 is sewn to edge 80, first portion 48 blouses away from edge 86 of third portion 52. To continue this blousing effect to the top of first portion 48, that portion includes pleats 56. These pleats reduce the width of edge 88 of the first portion so that this width is substantially equal to the width of third portion 52. This causes the entire first portion 48, as well as receptacle 54, to stand away from the back face of the backstop in the assembled system.

Figure 5:
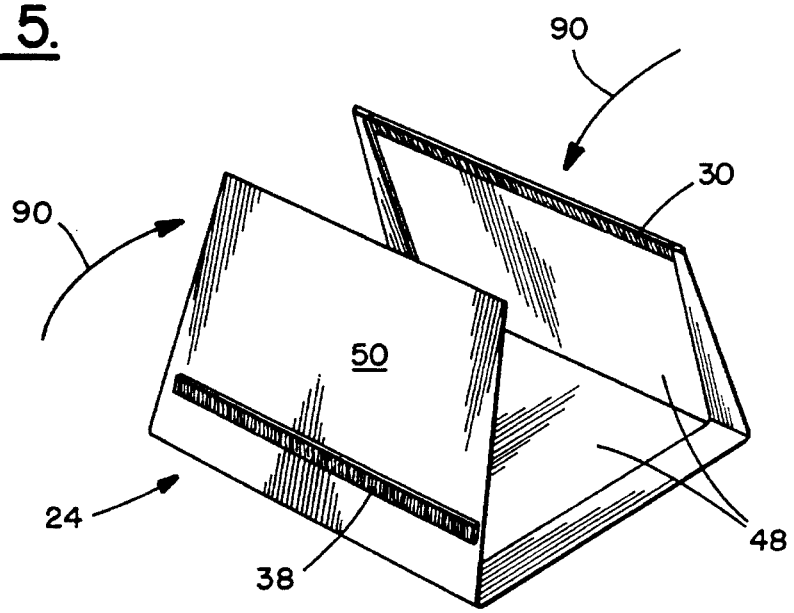
FIG. 5 is a perspective view showing folding of the pouch of FIG. 4.

In a particularly preferred embodiment of the invention, pouch 24 is used as a storage and transit container for backstop 10, as well as for elastic shock cords 16. To achieve this result, the pouch is sized so as to hold the backstop when folded. For a pouch having the configuration shown in FIGS. 5 and 6, a VELCRO strip 38 having a structure opposite to that of VELCRO strip 30 (e.g., a loop structure when strip 30 has a hook structure) is provided. This strip serves as a closure means for the pouch when the folded backstop is placed into receptacle 54. Arrows 90 in FIG. 5 illustrate the manner in which pouch 24 can be closed using VELCRO strips 30 and 38. Instead of VELCRO strips, other closure means, such as, snaps, hooks and eyes, etc., can be used if desired.

Figure 7:
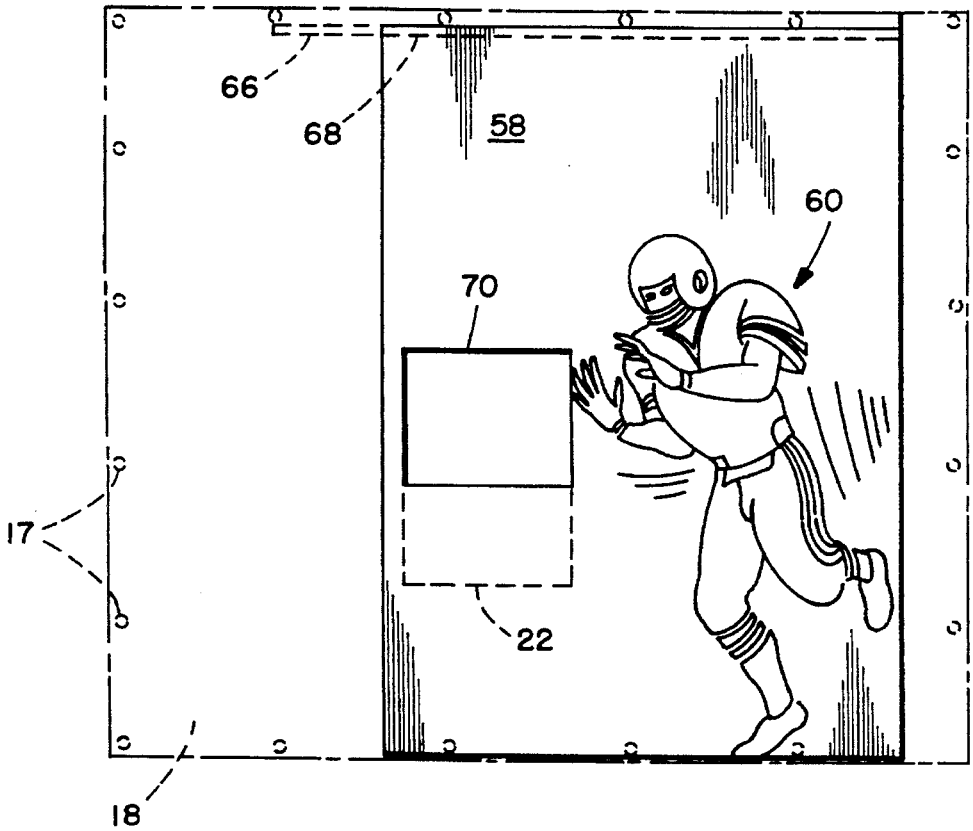
FIG. 7 is a front view of a football overlay for use with the system of FIG. 1.
Figure 8:
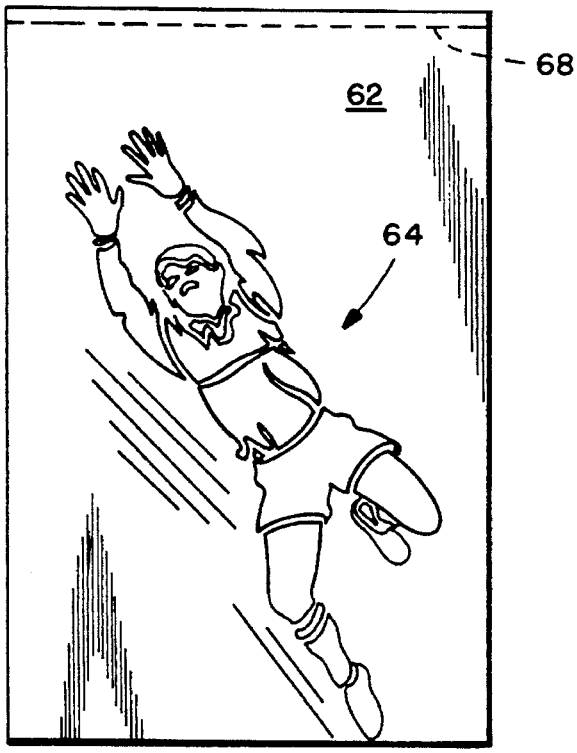
FIG. 8 is a front view of a soccer overlay for use with the system of FIG. 1.

FIGS. 7 and 8 illustrate the overlay aspect of the invention. FIG. 7 shows a football overlay 58 having a football graphic 60, while FIG. 8 shows a soccer overlay 62 having a soccer graphic 62. The back surface of each overlay includes a VELCRO strip 68, which mates with VELCRO strip 66 on the front face 18 of backstop body to releasably attach the overlay to the backstop. Preferably, strip 66 is of the loop type and strips 68 are of the hook type, although the opposite arrangement can be used if desired. Instead of VELCRO strips, the overlays can be releasably attached to the backstop by other means, including snaps, clips, S-hooks and grommets, cable ties, and the like.

As shown in FIG. 7, overlay 58 includes its own aperture 70 which is aligned with aperture 22 in the backstop body when the overlay is attached to the backstop. Aperture 70 has a smaller size than aperture 22 and provides a more appropriate target for practicing football. Overlay 62 of FIG. 8 does not include an aperture and is designed to cover aperture 22 when attached to the backstop. Other overlay configurations can be used in the practice of the invention, such as a single overlay which is located to one side of aperture 22 or multiple overlays which may or may not cover all or a part of aperture 22.

Backstop 10 is preferably composed of an open-weave fabric so as to reduce the backstop's weight and minimize wind forces on the backstop and its external support. The fabric also needs to be weather resistant and strong enough to withstand hard use. In addition, the fabric is preferably one which can be screen printed so that the various graphic designs shown in the figures can be conveniently and dramatically portrayed.

Figure 9:
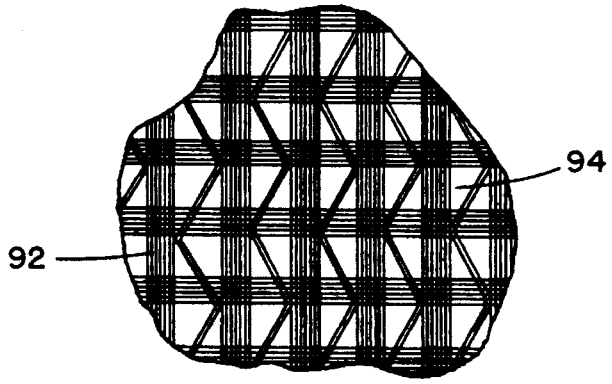
FIG. 9 is an expanded view showing an open-weave fabric suitable for use in preparing the backstop of the system of FIG. 1.

A suitable fabric having these characteristics is polyvinylchloride-coated polyester, e.g., BONDCOTE brand PVC-coated polyester mesh scrim (Catalog #60-606, Bond Cote Corporation, Dublin, Va). This is a 1,000 denier material having a 9×12 count, i.e., 9 warp threads and 12 weft threads. FIG. 9 shows the open-weave character of this material, where the reference number 92 indicates the fabric's fibers and reference number 94 indicates its openings. In this material, the PVC coating strengthens and weather protects the underlying polyester fibers. Also, screen printing can be performed on the coating provided PVC compatible inks are used, e.g., vinyl inks, such as those produced by Naz-Dar/KC, (Chicago, Ill.), whose viscosity has been adjusted by the addition of reducers and extenders appropriate to the equipment and mesh being used.

Pouch 24 can be formed of the same material as backstop 10. Preferably, pouch 24 and, in particular, the portion of the pouch that is located behind aperture 22, is of a different color than the backstop to provide a target for the ball or other moving object.

Backstop 10 preferably has a width of at least about 5 feet and a height of at least about 7 feet so that it is large enough to be effectively used by children of all ages, including young children. The size of the backstop will generally correspond to the external support with which the equipment is designed to be used, e.g., a swingset or garage door frame. Suitable dimensions for the backstop are between, for example, 5 feet, 11 inches wide by 7 feet, 7 inches high and 9 feet, 10 inches wide by 7 feet, 7 inches high. Flap 76 preferably has a depth of about 5 inches.

Aperture 22 can have various dimensions depending upon the sport for which the system is being used. Suitable dimensions for aperture 22 for a baseball application are 17.5 inches wide by 24 inches high. Suitable dimensions for pouch body 26 for use with such an aperture are: first portion 48—27.5 inches wide at the top before pleating, 19.5 inches wide at the top after pleating, 27 inches wide at the bottom, and 26.5 inches high; second portion 50—27 inches wide at the top, 19 inches wide at the bottom, and 13 inches high; and third portion 52—19 inches wide by 13 inches high.

Although specific embodiments of the invention have been described and illustrated, it is to be understood that modifications can be made without departing from the invention's spirit and scope. For example, apertures having a non-rectangular shape, e.g., round apertures, apertures in different places than that shown in the figures, e.g., a lower aperture for hockey, and multiple apertures in a single backstop can be used in the practice of the invention.

Similarly, although the invention will most often be used for practicing a sport, it can also be used during play of the sport with the aperture serving as an impartial "umpire". For example, for a baseball application, balls which are not swung at and which are captured in the pouch would be considered strikes, while those missing the pouch would be balls.

A variety of other modifications which do not depart from the scope and spirit of the invention will be evident to persons of ordinary skill in the art from the disclosure herein. The following claims are intended to cover the specific embodiments set forth above as well as such modifications, variations, and equivalents.

What is claimed is:

1. A system for playing or practicing one or more sports, each of said sports employing a moving object, comprising:

(a) a backstop for interrupting the flight of the moving object, said backstop comprising a backstop body and means for releasably attaching the backstop body to an external support, said backstop body having a front face and a back face and an aperture;

(b) a pouch for collecting a moving object which has passed through the aperture, said pouch being formed of a fabric material and having a pouch body which forms an opening, said pouch body comprising first, second, and third portions, the first portion being located behind the aperture, the second and third portions being attached to one another to form a receptacle for the moving object, the first portion having a width which is wider than that of the third portion, and the second portion having a graduated width which progresses from that of the first portion to that of the third portion; and (c) means for releasably attaching the pouch to the back face of the backstop body so that the opening formed by the pouch body surrounds the aperture;

wherein the configuration of the pouch body causes it to stand away from the back face of the backstop body without the application of an external force to the pouch body.

2. The system of claim 1 wherein the backstop body is composed of an open-weave fabric which can be screen printed and the front face of the backstop body includes a graphic design which has been screen printed onto the fabric.

3. The system of claim 2 wherein the fabric has a polyvinylchloride coating.

4. The system of claim 3 wherein the fabric is a polyvinylchloride-coated polyester.

5. The system of claim 1 wherein the means for releasably attaching the pouch to the back face of the backstop body comprises a first strip of material which substantially surrounds the aperture and a second strip of material which substantially surrounds the opening, one of the first and second strips being a hook strip and the other of the first and second strips being a loop strip.

6. The system of claim 1 wherein the first portion includes pleats along its top edge which cause the width of the top edge, after pleating, to be substantially equal to the width of the third portion.

7. The system of claim 1 wherein the first portion has a height which is substantially equal to the height of the aperture and wherein the width of the third portion is substantially equal to the width of the aperture.

8. The system of claim 1 further comprising an overlay for covering a portion of the front face of the backstop and means for releasably attaching the overlay to the system.

9. The system of claim 8 wherein the overlay changes the size of the aperture.

10. The system of claim 8 wherein the overlay covers the aperture.

11. The system of claim 1 wherein the backstop is foldable and the pouch is sized to hold the folded backstop.

12. The system of claim 11 wherein the pouch includes closure means for retaining the folded backstop within the pouch.

13. The system of claim 1 wherein the backstop includes means for weighting its bottom end.

14. The system of claim 13 wherein the means for weighting the backstop's bottom end comprises a sleeve for receiving a dowel.

15. The system of claim 1 wherein the backstop includes a flap at its bottom end which extends away from the front face of the backstop.

16. The system of claim 1 wherein the external support is a swingset frame.

17. A system for playing or practicing one or more sports, each of said sports employing a moving object, comprising:

(a) a backstop for interrupting the flight of the moving object, said backstop comprising a backstop body and means for releasably attaching the backstop body to an external support, said backstop body having a front face and a back face and an aperture;

(b) a pouch for collecting a moving object which has passed through the aperture, said pouch being attached to the back face of the backstop body, said pouch being formed of a fabric material and having a pouch body which forms an opening, said pouch body comprising first, second, and third portions, the first portion being located behind the aperture, the second and third portions being attached to one another to form a receptacle for the moving object, the first portion having a width which is wider than that of the third portion, and the second portion having a graduated width which progresses from that of the first portion to that of the third portion;

(c) an overlay for covering a portion of the front face of the backstop; and (d) means for releasably attaching the overlay to the system, wherein the configuration of the pouch body causes it to stand away from the back face of the backstop body without the application of an external force to the pouch body.

18. The system of claim 17 wherein the overlay changes the size of the aperture.

19. The system of claim 17 wherein the overlay covers the aperture.

20. The system of claim 17 wherein the front face of the backstop includes a first graphic and the overlay includes a second graphic.

21. A system for playing or practicing one or more sports, each of said sports employing a moving object, comprising:

(a) a swingset frame;

(b) a backstop for interrupting the flight of the moving object, said backstop comprising a backstop body and means for releasably attaching the backstop body to the swingset frame, said backstop body having a front face and a back face and an aperture; and (c) a pouch for collecting a moving object which has passed through the aperture, said pouch being attached to the back face of the backstop body, said pouch being formed of a fabric material and having a pouch body which forms an opening, said pouch body comprising first, second, and third portions, the first portion being located behind the aperture, the second and third portions being attached to one another to form a receptacle for the moving object, the first portion having a width which is wider than that of the third portion, and the second portion having a graduated width which progresses from that of the first portion to that of the third portion, wherein the configuration of the pouch body causes it to stand away from the back face of the backstop body without the application of an external force to the pouch body.

22. A pouch for surrounding the aperture of a backstop used to interrupt the flight of a moving object, said pouch being formed of a fabric material and comprising first, second, and third portions, the first portion being located behind the aperture during use of the pouch, the second and third portions being attached to one another to form a receptacle for the moving object, the first portion having a width which is wider than that of the third portion, and the second portion having a graduated width which progresses from that of the first portion to that of the third portion.

23. The pouch of claim 22 wherein the first portion includes pleats along its top edge which causes the width of the top edge, after pleating, to be substantially equal to the width of the third portion.

24. The pouch of claim 22 wherein the backstop is foldable and the pouch is sized to hold the folded backstop.

25. The pouch of claim 24 wherein the first portion includes a first strip of material and the second portion includes a second strip of material, one of the first and second strips being a hook strip and the other of the first and second strips being a loop strip, said first and second strips serving to close the pouch so as to retain the folded backstop within the pouch.

* * * * *